United States Patent [19]

Sutherland

[11] Patent Number: 4,526,316

[45] Date of Patent: Jul. 2, 1985

[54] LOCK ARRANGEMENT FOR CARTONS

[75] Inventor: Robert L. Sutherland, Campbell Hall, N.Y.

[73] Assignee: Federal Paper Board Co., Inc., Montvale, N.J.

[21] Appl. No.: 358,879

[22] Filed: Mar. 16, 1982

[51] Int. Cl.[3] ..... B65D 75/00

[52] U.S. Cl. ..... 229/40; 229/39 R; 229/45 R; 206/140; 206/152; 206/157; 206/434

[58] Field of Search ..... 206/140, 152, 156, 157, 206/174, 141, 145, 429, 434; 229/39 R, 40, 38, 45 R; 24/204

[56] References Cited

U.S. PATENT DOCUMENTS

| | | | |
|---|---|---|---|
| 2,865,549 | 12/1958 | Inman | 229/15 |
| 2,973,129 | 2/1961 | Stone et al. | 229/39 R |
| 3,014,636 | 12/1961 | Fielding | 229/39 R |
| 3,035,692 | 5/1962 | Forrer | 206/140 |
| 3,288,349 | 11/1966 | Palmer et al. | 229/45 |
| 3,451,535 | 6/1969 | Caplan | 229/39 R |
| 3,462,011 | 8/1969 | Farquhar | 206/140 |
| 3,462,066 | 8/1969 | Farquhar | 229/39 R |
| 3,589,593 | 6/1971 | Weiss | 229/40 |
| 3,655,117 | 4/1972 | Weiss | 229/40 |
| 3,705,681 | 12/1972 | Rossi et al. | 206/140 |
| 4,200,220 | 4/1980 | Ganz | 229/40 |

*Primary Examiner*—Allan N. Shoap
*Assistant Examiner*—Bryon Gehman
*Attorney, Agent, or Firm*—Charles A. Brown; Charles E. Brown

[57] ABSTRACT

This relates to a closure panel and lock arrangement for cartons of the wrap around type. There are two features. In lieu of the usual primary lock, an outer closure panel is merely provided with divider tabs which extend through suitable apertures in an inner closure panel and extend between articles disposed in adjacent rows within the carton. The inner closure panel may be provided with a female locking slot for receiving the divider tab. There is a locking arrangement similar to the customary secondary lock and utilizing a male locking member of the usual type. However, there is provided a separate female locking slot in the inner closure panel immediately adjacent its folded connection to a side panel of the carton with the female locking slot being formed by a single knife arrangement forming cut lines without the removal of material and the shapes of the cut lines being such to provide for automatic opening of the female locking slot when the inner closure panel is folded relative to the adjacent side panel and defining flexible locking ears which will lock behind shoulders of the male locking tab.

11 Claims, 6 Drawing Figures

LOCK ARRANGEMENT FOR CARTONS

This invention relates in general to new and useful improvements in cartons of the wrap around type, and more particularly to a lock arrangement for locking together closure panels of such cartons.

In an existing type of closure panel and lock arrangement, there is an inner closure panel and an outer closure panel with the inner closure panel having large openings therein extending generally from a fold line connecting the inner closure panel to a side panel of a carton. Along the fold line at one side of each opening is a slot for receiving a male locking tab of a secondary lock. The opposite side of the opening defines a ledge behind which a primary locking tab engages.

In accordance with this invention there is provided a new female slot arrangement which includes a first cut line defining a pair of spaced locking ears and second cut lines intersecting the first cut line at adjacent sides of the ears and extending away from the first cut line whereby the ears are free to deflect for receiving and having locked therebehind a male locking tab. The female slot arrangement, by being formed at and immediately adjacent the fold line connecting the associated closure panel with a side panel of a carton is defined solely by cut lines and when the panels are folded generally at right angles to each other, a slot for receiving the male locking tab is automatically formed.

Another feature of this invention is to provide a closure panel and lock arrangement wherein in lieu of the primary locks, the outer closure member is provided with divider tabs which extend through suitable slots in an inner closure member and are positioned between adjacent articles in two rows of articles within the carton. The slot arrangements for receiving the divider tabs may be conventional and may be at one side of a respective opening in the inner closure panel.

It is preferred that the lock associated with the divider tab arrangement be of the type utilizing the aforementioned female slot arrangement and including a male locking tab of the type which is joined to a panel by a narrow neck and having locking shoulders on each side of the neck, which locking shoulders engage behind ears defined by the female slot arrangement with the neck of the male locking tab being disposed between the ears.

With the above and other objects in view that will hereinafter appear, the nature of the invention will be more clearly understood by reference to the following detailed description, the appended claims, and the several views illustrated in the accompanying drawings.

IN THE DRAWINGS

Figures 1, 2, 3, 4, 5, 6:
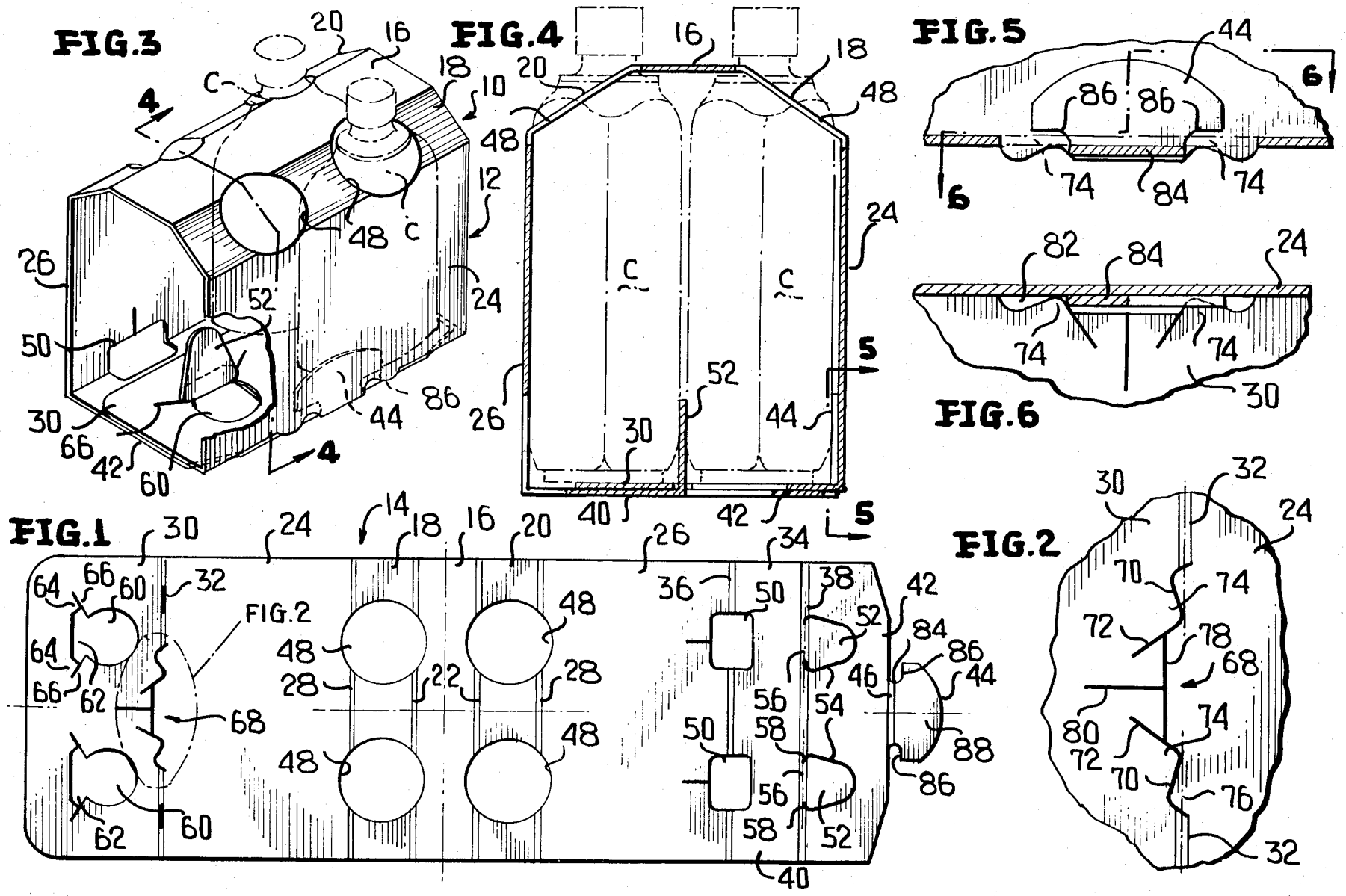
FIG. 1 is a plan view of a typical carton blank of the type employing the closure panel and locking arrangement of this invention.
FIG. 2 is an enlarged fragmentary plan view of the blank of FIG. 1 showing the specific details of the cut lines defining the female slot arrangement.
FIG. 3 is a perspective view with parts broken away of a typical wrap around carton package arrangement formed in accordance with this invention.
FIG. 4 is an enlarged transverse vertical sectional view taken generally along the lines 4—4 of FIG. 3 and shows further the details of the closure panel arrangement and lock structure.
FIG. 5 is an enlarged fragmentary longitudinal vertical sectional view taken generally along the line 5—5 of FIG. 4 and shows the specific relationship of the male locking tab and the female slot arrangement.
FIG. 6 is a fragmentary horizontal sectional view taken generally along the line 6—6 of FIG. 5 and shows further the relationship of the male locking tab and the female slot arrangement.

Referring now to the drawings in detail, it will be seen that there is illustrated a typical package, generally identified by the numeral 10, utilizing a carton, generally identified by the numeral 12, incorporating closure panels and locking means in accordance with this invention. The carton 12, which is merely illustrative of an application of the invention, is formed from a blank generally identified by the numeral 14.

The blank 14 is of an elongated generally rectangular configuration and is preferably formed of paperboard. The blank 14 includes a central top panel 16 having disposed on opposite sides thereof outer top panels 18 and 20 which are connected to the central top panel 16 along fold lines 22. Side panels 24 and 26 are connected to the outer top panels 18 and 20, respectively, along fold lines 28.

The blank 10 also includes an inner closure panel 30 which is connected to the side panel 24 along an interrupted fold line 32, and an outer closure panel 34 which is connected to the side panel 26 along a fold line 36. The closure panel 34 is provided with a central fold line 38 dividing the closure panel 34 into panel halves 40 and 42.

The blank 14 terminates in a male locking tab 44 of a conventional type which projects from the closure panel 34 and is connected thereto along a fold line 46. At this time it is pointed out that all of the aforedescribed fold lines extend transversely of the blank 14, but longitudinally of the carton 12.

The panels 18 and 20 are provided with circular openings 48 therethrough centered with respect to positions of containers to be packaged for the purpose of receiving neck portions of such containers as will be described hereinafter.

In order to facilitate tightening of the carton 12 around the containers C which are being packaged, the blank 14 may also include suitable openings 50 which are spaced along the fold line 36 and are also aligned with the positions of the containers within the carton.

In lieu of the customary primary and secondary locks, the blank 14 is provided with a pair of divider tabs 52 which are cut from the panel portion 42 by way of cut lines 54 which terminate along the fold line 38. It will be seen that each divider tab 52 is integrally connected to the outer closure panel 40 along the fold line 38 and has a connecting portion 56 along the fold line 38 which is shorter than the width of the divider tab adjacent to the fold line so as to define relatively short shoulders 58.

The inner closure panel 30 is provided with a pair of openings 60 which are aligned with the divider tabs 52. Each opening 60 terminates in a slot arrangement 62 which extends longitudinally of the carton 12. The slot arrangement 62 includes a pair of deflectable ears 64 at each end of the slot arrangement which are in part defined by diagonal cut line 66. The female slot arrangement 62 may be in accordance with U.S. Pat. No. 3,589,593.

The invention in particular relates to the details of a female slot arrangement which receives and cooperates with the male locking tab 44. The female slot arrangement, which is generally identified by the numeral 68, extends between the ends of the interrupted fold line 32, as is best shown in FIG. 2. The female slot arrangement 68, which is formed by a single knife primarily within the inner closure panel 30, includes remote generally S-shaped cut line portions 70 which terminate in converging straight cut line portions 72. These cut line portions define locking ears 74 which are formed wholly from the inner closure panel 30 and have their tips spaced from a center line 76 of the interrupted fold lines 32. The straight cut lines 72 are joined by a cut line 78 which is parallel to and offset from the interrupted fold line 32. The female slot arrangement 68 further includes a centrally located cut line 80 which extends from the cut line 78 longitudinally of the blank 14 and terminate at a point where the cut line portion 72, if extended, would intersect.

Referring now to FIG. 6 in particular, it will be seen that when the inner closure panel 30 is folded at right angles to the side panel 24, as occurs when the carton 12 is formed, those portions to the right of the cut line portions 70 and 78 and integrally connected to the side panel 24 will swing into a vertical position and thus define an open slot 82 through which the male locking tab 44 may freely pass.

Reference is made once again to the male locking tab 44 and most particularly to the narrow neck 84 thereof which defines in opposition to the edge of the outer closure panel 34 a pair of locking shoulders 86 on a head 88 of the male locking tab 44.

Referring once again to FIG. 6 and also FIG. 5, it will be seen that the width of the neck 84 is slightly narrower than the spacing of the tips of the locking ears 74 so that when the male locking tab 44 is inserted vertically through the slot 82 in the completed carton, the shoulders 86 will be engaged behind or above the locking ears 74. It will also be seen that inasmuch as the slot 82 is defined by cut lines only, the male locking tab 44 will be tightly pressed within the slot 82 by the projecting portions of the inner closure panel 30 against the upstanding side panel 24. Thus the interlocking of the male locking tab 44 with the inner closure panel 30 will be maintained.

Referring once again to FIGS. 3 and 4, it will be seen that the blank 14 is applied to four containers C by engaging the top panels 16, 18 and 20 over and against the top portions of the containers C and by folding the side panels 24, 26 down alongside the containers. The inner closure panel 30 is then folded up beneath the containers C of one row to the position illustrated in FIG. 4 after which the outer closure panel 34 is folded along the fold line 38 to present the divider tabs 52 to the slots 62. The divider tabs 52 then pass through the slots 62 up between the containers of the two rows, as is also shown in FIGS. 3 and 4.

Finally, the outer closure panel portion 42 and the male locking tab 44 carried thereby will be pivoted to present the male locking tab up through the female locking slot arrangement 68 in general and more particularly the slot 82 to its locked position alongside the inner surface of the side panel 24. The assembly of the carton is now complete and the required package 10 is now formed.

Although only a preferred embodiment of the invention has been specifically illustrated and described herein, it is to be understood that the closure panel and locking arrangement may be utilized in other cartons and minor variations may be made in the configuration of the locking components without departing from the spirit and scope of the invention as defined by the appended claims.

I claim:

1. For use in a carton lock of the type including a male locking tab joined to the carton by a narrow neck having a locking shoulder on each side of said neck, an improved lock including a female slot arrangement formed in said carton and comprising a single linearly continuous first cut line having spaced generally aligned portions defining a pair of spaced locking ears and second cut lines intersecting said first cut line at adjacent sides of said ears and extending away from the general line of said first cut line wherein said ears are free to deflect.

2. A lock arrangement according to claim 1 wherein said second cut lines converge towards each other away from said first cut line.

3. A lock arrangement according to claim 1 wherein said second cut lines converge towards each other away from said first cut line, and there is a third cut line intermediate said second cut lines and extending generally normal to the general line of said first cut line and in combination with said second cut lines defining bendable flaps.

4. A lock arrangement according to claim 1 wherein said first cut line portions starting at each of said locking ears and extending to an adjacent end of said first cut line are generally S-shaped in outline.

5. A lock arrangement according to claim 1 wherein said first cut line portions starting at each of said locking ears and extending to an adjacent end of said first cut line are generally S-shaped in outline, and each second cut line forms a continuation of a respective one of said S-shaped first cut line portions.

6. A lock arrangement according to claim 1 wherein said carton includes first and second adjacent panels joined by a fold line, said first and second cut lines being formed in said first panel with said first cut line extending generally along said fold line and defining a slot parallel to and adjacent to said fold line in said first panel when said first and second panels are folded relative to each other.

7. A lock arrangement according to claim 6 wherein said first and second panels are folded generally at right angles to each other, said carton includes a third panel underlying said first panel and carrying said male locking tab, said male locking tab projecting through said slot and having said locking shoulder projecting beyond said locking ears and engaged by said locking ears with said neck being centered between said locking ears, said male locking tab being disposed alongside said second panel.

8. A lock arrangement according to claim 6 wherein said locking ears have tips offset from a center of said fold line.

9. In a carton of the wrap around type of a size for receiving articles in two rows, a closure panel and lock arrangement comprising an inner closure panel and an outer closure panel, said inner closure panel having a plurality of longitudinal slots therein located along the longitudinal center of said carton, there being one longitudinal slot for each intended article in a row and positioned for alignment between articles of adjacent rows, said outer closure panel having struck therefrom a divider tab for each of said longitudinal slots for projecting through said longitudinal slots genrally normal to said closure panels and forming locking means between said closure panels, said inner closure panel being connected to a carton side panel generally at right angles thereto along a fold line, at leat one female slot arrangement formed in said inner closure panel along said fold line, and a terminal male locking tab carried by said outer closure panel extending through each said female slot arrangement and locked behind said inner closure panel, said female slot arrangement including in said inner closure panel a first cut line having spaced generally aligned portions defining a pair of spaced locking ears and second cut lines intersecting said first cut line at adjacent sides of said ears and extending away from the general line of said first cut line wherein said ears are free to deflect.

10. A closure panel and lock arrangement according to claim 9 wherein said first cut line portions starting at each of said locking ears and extending to an adjacent end of said first cut line are generally S-shaped in outline.

11. A closure panel and lock arrangement according to claim 9 wherein said first cut line portions starting at each of said locking ears and extending to an adjacent end of said first cut line are generally S-shaped in outline, and each second cut line forms a continuation of a respective one of said S-shaped first cut line portions.

* * * * *